US010472030B2

(12) United States Patent
Palfinger

(10) Patent No.: US 10,472,030 B2
(45) Date of Patent: Nov. 12, 2019

(54) TRANSPORT SYSTEM

(71) Applicant: Hubert Palfinger Technologies GMBH, Salzburg (AT)

(72) Inventor: Hubert Palfinger, Salzburg (AT)

(73) Assignee: Hubert Palfinger Technologies GmbH, Salzburg (AT)

( * ) Notice: Subject to any disclaimer, the term of this patent is extended or adjusted under 35 U.S.C. 154(b) by 0 days.

(21) Appl. No.: 16/302,241

(22) PCT Filed: May 16, 2017

(86) PCT No.: PCT/AT2017/060128
§ 371 (c)(1),
(2) Date: Nov. 16, 2018

(87) PCT Pub. No.: WO2017/197422
PCT Pub. Date: Nov. 23, 2017

(65) Prior Publication Data

US 2019/0185118 A1 Jun. 20, 2019

(30) Foreign Application Priority Data

May 17, 2016 (AT) ..... A 50459/2016

(51) Int. Cl.
*B63B 59/10* (2006.01)
*B24C 3/06* (2006.01)
(Continued)

(52) U.S. Cl.
CPC ..... *B63B 59/10* (2013.01); *B24C 3/062* (2013.01); *B63B 9/00* (2013.01); *B63B 59/06* (2013.01);
(Continued)

(58) Field of Classification Search
CPC ..... B63B 59/10; B63B 59/06; B63B 9/00; B24C 3/062; B63C 5/00; B63C 5/02; B63C 2005/025
See application file for complete search history.

(56) References Cited

U.S. PATENT DOCUMENTS 5,027,712 A * 7/1991 Wallick ..... A63H 21/02 104/108
5,611,419 A * 3/1997 LaVars ..... B65G 47/965 198/370.04
(Continued)

FOREIGN PATENT DOCUMENTS

DE 8526213 U1 1/1987
JP 2002021321 A 1/2002
(Continued)

*Primary Examiner* — Stephen P Avila
(74) *Attorney, Agent, or Firm* — Dykema Gossett PLLC

(57) ABSTRACT

This invention relates to a transport system for moving at least one automated maintenance device for large substantially perpendicular surfaces, for example ship hulls, comprising a monorail system which can be laid freely and at least one drive device which can be moved on the monorail system along a movement direction. The at least one drive device has a drive unit with at least one running wheel, and the running wheel can be driven via at least one drive, preferably an electric drive. At least one pressing unit, is provided which is connected to the drive unit). The at least one pressing unit has at least one loading roller which can be pressed onto the monorail system via at least one spring element, and/or a fixing device is arranged on the drive unit, wherein a fixing roller is provided which interacts with the monorail system.

19 Claims, 6 Drawing Sheets

(51) Int. Cl.

| | |
|---|---|
| ***B63B 9/00*** | (2006.01) |
| ***B63B 59/06*** | (2006.01) |
| ***B63C 5/00*** | (2006.01) |
| ***B63C 5/02*** | (2006.01) |

(52) U.S. Cl.
CPC ..... *B63C 5/00* (2013.01); *B63C 5/02* (2013.01); *B63C 2005/025* (2013.01)

(56) References Cited

U.S. PATENT DOCUMENTS 5,784,966 A * 7/1998 Brown ..... B61B 3/02
104/118
5,816,169 A * 10/1998 MacKenzie ..... A63H 21/04
105/141

FOREIGN PATENT DOCUMENTS

WO 2010057942 A1 5/2010
WO 2012080448 A1 6/2012

* cited by examiner

TRANSPORT SYSTEM

CROSS-REFERENCE TO RELATED APPLICATIONS

This application is a national stage filing based upon International PCT Application No. PCT/AT2017/060128, filed 16 May 2017, which claims the benefit of priority to Austria application No. A 50459/2016, filed 17 May 2016.

BACKGROUND

The invention relates to a transport system for moving at least one automated maintenance device for large, essentially vertical surfaces, such as ship hulls, having a monorail system which can be laid freely and at least one drive device which can be moved along one direction of movement on the monorail system.

In many areas of technology, large surfaces, for example made of steel, have to be examined and machined. In particular, ship hulls must be protected against corrosion at regular intervals by removing old paints and applying new ones. Maintenance devices such as those described in EP 2 651 754 B1 of the applicant are used for this task. These maintenance devices are usually moved on rails along these hulls in the dock facilities where vessels are inspected and overhauled. Usually the rail systems are rigid, i.e. mounted on the dock in a form-fit manner or arranged within a track bed, so that the maintenance device has to compensate for differences in the distance between the rail system and the surface to be machined. However, since the size and/or shape of the vessels vary, and there is also an increasing distance between the maintenance device and the ship hull, particularly in the bow and stern areas of the vessel, the maintenance device in such rail systems must compensate for this distance in accordance with the prior art, which makes it extremely difficult to stabilize the maintenance device during operation. Such rail systems are therefore extremely inflexible.

The maintenance devices moved on rails usually have a high dead weight. Furthermore, due to their mostly crane- or tower-like construction during maintenance work, they always have a center of gravity that shifts towards the rails and is usually located at a great distance from the base. However, this causes a large moment of force to act on the rail system, so that there is always a risk of the rail being displaced or lifted off. This subsequently leads to instability of the maintenance device, especially if it is moved along the rail.

It is therefore the object of the invention to overcome the disadvantages of the prior art and to provide a transport system that allows a repeatedly precise and controlled movement of a load, for example a maintenance device, along a freely laid rail.

SUMMARY OF THE INVENTION

This object is achieved in accordance with the invention by a transport system of the type mentioned above in that the at least one drive device has a drive unit with at least one running wheel, wherein the running wheel can be driven via at least one preferably electric drive, and furthermore at least one pressing unit is provided, which is connected to the drive unit, wherein the at least one pressing unit has at least one loading roller which can be pressed against the monorail system via at least one spring element, and/or a fixing device is arranged on the drive unit, wherein a fixing roller which interacts with the monorail system is provided.

The drive device is designed to increase the friction between the monorail system, which is not positively anchored, and its base when travelling with a heavy load, in particular a maintenance device.

It is the object of the pressing unit according to the invention to press the rail section before and after the drive unit (seen in the direction of movement) onto the base and to prevent the monorail system from lifting off or shifting. The drive device according to the invention prevents a vertical change in position by lifting and/or a horizontal change in position in the form of displacements of the monorail system due to load acting on the monorail system. The at least one spring element of the pressing unit presses the loading roller onto the rail surface, which runs parallel to the base. The pressing unit thus acts vertically on the rail section to ensure the required stability of this rail section in the immediate vicinity of the drive unit and the maintenance device located thereon.

A fixing device is additionally or alternatively arranged on the drive unit, wherein a fixing roller is provided which cooperates with the rail for fixing the direction of the drive device according to the invention. This fixing device works essentially in one plane parallel to the base and is in contact with a rail flank in particular. An essential advantage of the fixing device according to the invention is that it prevents the rail section from turning or twisting due to high shear forces caused by the load arranged on the drive device.

In order to stabilize the position of the pressing unit on the monorail system, it is provided according to a preferred embodiment of the invention that the at least one pressing unit is in contact with the monorail system via at least one, preferably two guide wheels. These guide wheels are arranged in a plane parallel to the base and are in frictional contact with the flank of the rail section.

The at least one pressing unit is preferably in articulated connection with the drive unit. If the drive device is moved along the monorail system, the pressing unit is located in front of or behind the drive device, depending on the direction of movement. Since the monorail system laid on the base is usually not in a straight line, but follows the ship's contours, for example, the articulated connection between the drive unit and the pressing unit allows a flexible movement of the device along a monorail system with a curved course.

The movement of the drive device on the monorail system is further improved in a further embodiment of the invention when the at least one pressing unit is connected to the drive unit via a swivel arm with one, sometimes two, swivel axes.

Controlled and safe movement of the load attached to the drive device is further improved by the fact that, in a preferred embodiment of the invention, the drive unit is additionally in contact with the monorail system via at least one, preferably two guide rollers, wherein the axis of rotation of the at least one, preferably two guide rollers is substantially normal to the axis of rotation of the running wheel of the drive unit. Thus the running wheel of the drive unit is in frictional contact with the rail surface, while at least one guide roller of the drive unit is in contact with a rail flank.

The function of the fixing device according to the invention is further improved if it has at least one, preferably two pivoting stabilizing rollers which interact with the monorail system.

In this case it is particularly preferably provided that the at least one, preferably two pivotable stabilizing rollers can be pressed against the rail section via an adjusting device, preferably via at least one hydraulic cylinder. Depending on the direction of movement, the stabilizing roller which precedes the fixing roller is pressed against the rail flank in order to improve the stability of the drive device on the monorail system.

The drive device is designed to take loads and move them via the monorail system. For this purpose, a particularly preferred variant provides that the drive device is equipped with a load-bearing device, preferably a king pin. This type of load bearing device is particularly suitable for connecting the drive device to a crane-type maintenance device because a king pin provides an additional axis of rotation which allows the maintenance device to be rotated relative to the drive device. This allows, for example, the maintenance device to be optimally aligned with the surface to be machined, for example a ship's hull.

In a further preferred embodiment of the invention it is provided that the monorail system has a plurality of rail segments, wherein preferably at least two curved rail segments are provided which have a convexly constructed rail end piece and a concavely constructed rail end piece, and in the assembled state at least one convexly constructed rail end piece of a first curved rail segment is in articulated connection with a concavely constructed rail end piece of an adjacent second curved rail segment.

Such a modular rail system with only one rail track, on which at least one maintenance device can be moved, can be set up especially quickly and flexibly and adapted to the shape of the ship, because the individual curved rail segments can be pivoted to each other via the articulated connection and thus a suitable curved course of the rail track can be set.

In a preferred embodiment of the invention, the at least one convex rail end piece of the first curved rail segment engages in the concave rail end piece of the adjacent second curved rail segment, wherein a fitting bolt connects the two curved rail segments to one another in a pivotable manner. The assembly of the rail end pieces of the individual curved rail segments, which essentially fit perfectly, as well as the use of a fitting bolt for their connection, permits a particularly rapid assembly of the monorail system in accordance with the invention.

In order to adjust the curvature or the curve area of a track section of the monorail system according to the invention, it is provided that two set screws are preferably provided on each curved rail segment, which cooperate with a stop arranged on the adjacent curved rail segments. In order to simplify the mounting of the monorail system, the individual curved rail segments are first joined together and then, arranged on the base, are pivoted to each other via the articulated connection in order to achieve the desired curve shape of the track section.

A major advantage of this monorail system is that, due to its modular design, it can be flexibly adapted to practically any course of the track. Furthermore, no force-locked fixing of the individual rail segments to the base is provided. The positioning of the rail segments is achieved exclusively by force-locked/frictional connection, which is achieved by moving devices arranged on the monorail system, in particular maintenance devices, which are each arranged on at least one drive device in accordance with the invention.

It is provided in another preferred embodiment of the invention that additional ballast elements, preferably concrete slabs, can be arranged on at least one rail segment, and preferably on two adjacent rail segments, in order to further improve this frictional connection. Such ballast elements are also particularly advantageous at the end areas of the monorail system, which is usually not designed as a self-contained rail track, in order to prevent the rail segments located in the end area from lifting off and/or moving during operation.

In one variant of the present invention, at least one switch element is additionally provided, which allows maneuvering of the maintenance device(s) located on the monorail system.

Advantageously, at least one switch element has two switch tongues, which can be pivoted essentially parallel to each other and allow a rapid diversion of devices located on the monorail system.

The monorail system is predominantly installed outdoors, for example on ship docks. It is thus exposed to environmental conditions such as temperature fluctuations and solar radiation. As a result, the rail segments expand and shrink again, which can lead to considerable length changes when steel rail segments are used. These changes in length can in turn lead to distortions in the track run of the exposed monorail system. Therefore, preferably in addition, at least one length compensation element is provided to compensate for these changes in length caused by temperature.

In this case, the at least one length compensation element particularly preferably has two running surface elements which are separated from one another by a gap that preferably extends obliquely to the longitudinal axis of the length compensation element and which are arranged on a base element so as to be movable relative to one another. The changes in length can be absorbed by this changing gap.

The monorail system has proved to be particularly suitable for moving maintenance devices for processing essentially vertically extending surfaces, in particular ship hulls or container surfaces. As described above, it allows an individual and adaptable routing of the monorail system in order to bring a maintenance device movable on it into an optimal position to the surface to be machined, for example a ship's hull. The exclusive fixing of the monorail system to the base by means of force-locked/frictional connection enables particularly quick and flexible assembly and disassembly of the monorail system.

The transport system according to the invention has proved itself in particular for use with maintenance devices, because it allows flexible movement of automated maintenance devices in particular for processing large, essentially vertical surfaces, such as ship hulls, along exposed rails.

The object is also advantageously achieved by a maintenance system consisting of at least one maintenance device and the monorail system according to the invention, wherein the maintenance system is characterized in particular by quick assembly, adaptable routing and simple and reliable operation.

BRIEF DESCRIPTION OF THE DRAWINGS

In the following, the invention will be explained in more detail using non-restrictive embodiment examples with associated figures, wherein.

DETAILED DESCRIPTION

Figure 1:
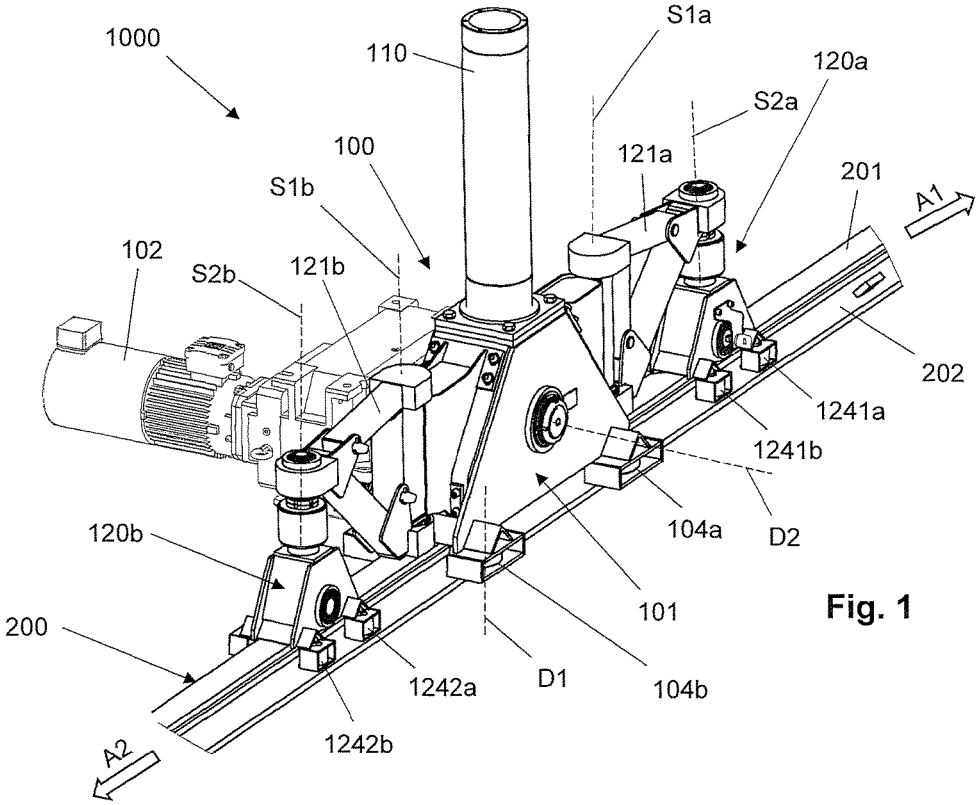
FIG. 1 shows a perspective view of the transport system according to the invention.

FIG. 1 shows the transport system 1000 according to the invention in a perspective view. Here a rail-bound drive device 100 can be moved along a monorail system 200 in two directions of movement A1, A2. The drive device 100 is provided, for example, for accommodating an automated maintenance device.

The drive device 100 has a drive unit 101 with a drive 102, wherein this drive 102 is designed, for example, as an electric drive in the form of an electric motor.

To support a load, for example a maintenance device, a connecting element 110, which in the present embodiment of the invention is designed as a king pin, is arranged on the drive unit 101.

Figure 2:
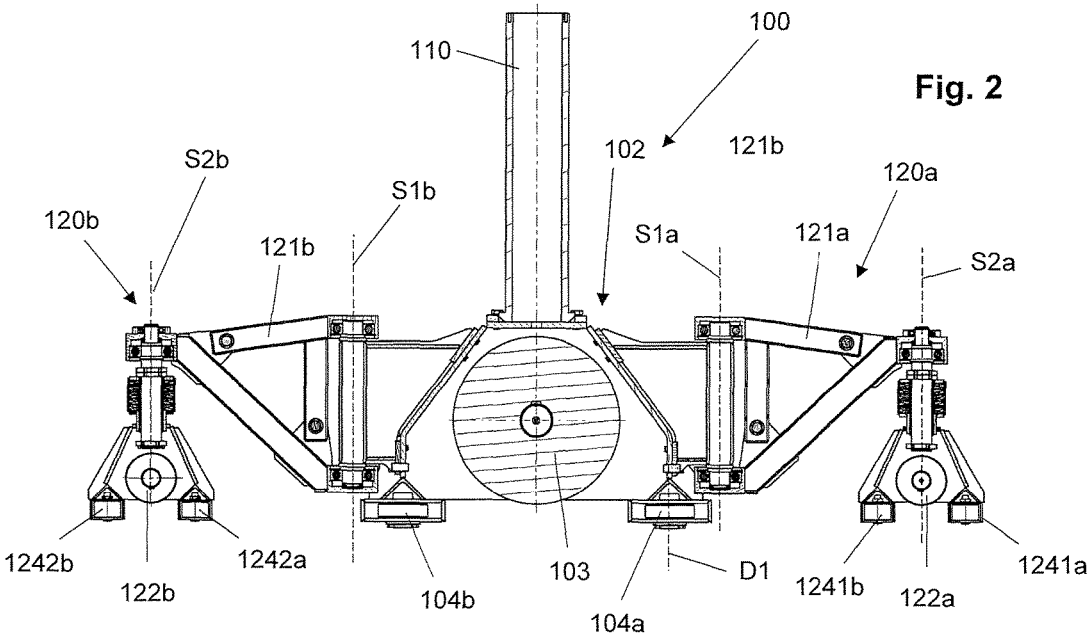
FIG. 2 a sectional view of the drive device from FIG. 1.

The sectional view of the rail-bound drive device 100 shown in FIG. 2 shows a running wheel 103 arranged in the drive unit 101, which is in friction contact with the rail surface 201, the upper flange (FIG. 1), and causes the movement of the rail-bound drive device 100 along the monorail system 200 via the drive 102. Since the running wheel 103 is moved substantially unguided along the sliding surface 201 as a non-profiled roller, two guide rollers 104*a*, 104*b* engaging in the rail flank 202 are provided, the axes of rotation D1 of which are substantially normal to a parallel to the axis of rotation D2 of the running wheel 103. In this way, the two guide rollers 104*a*, 104*b* stabilize the position of the running wheel 103 on the rail surface 201.

Figure 3:
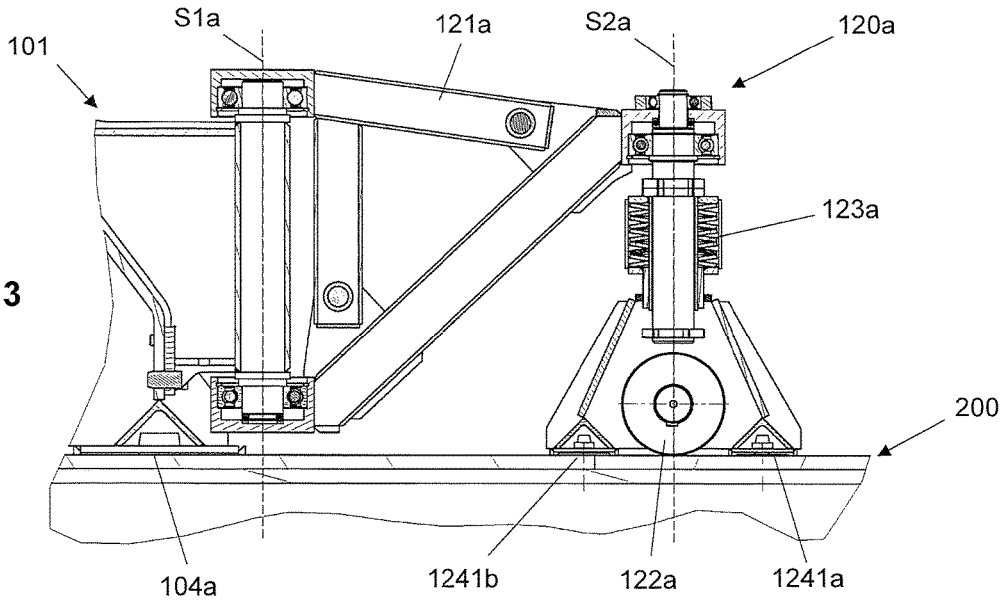
FIG. 3 shows a sectional view of the pressing unit from FIG. 1 and FIG. 2.

The rail-bound drive device 100 according to the invention has two pressing units 120*a*, 120*b* in this embodiment of the invention, which can be taken in detail in particular from FIG. 3. The pressing units 120*a*, 120*b* are each connected to the drive unit 101 via a swivel arm 121*a*, 121*b*. Each pressing unit 120*a*, 120*b* can be pivoted via two swivel axes S1*a*, S1*b*, S2*a*, S2*b* via the swivel arm 120*a*, 120*b*. Each pressing unit 120*a*, 120*b* also has a loading roller 122*a*, 122*b*, which is in contact with the rail surface 201. The loading roller 122*a*, 122*b* is pressed in this case onto the rail surface 201 via a spring element 123*a*, 123*b*. The spring element 123*a*, 123*b* is arranged in such a way that its longitudinal center axis, which coincides with the swivel axis S2*a*, S2*b*, stands normal to the base in order to ensure maximum transmission of force to the loading roller 122*a*, 122*b* and subsequently to the monorail system 200. This contact pressure ensures that the monorail system 200 is pressed onto the base in a stable and non-displaceable manner. An improved guidance of the pressing unit 120*a*, 120*b* is achieved by the additional guide wheels 1241*a*, 1241*b*, 1242*a*, 1242*b* of the pressing units 120*a*, 120*b*, which in turn are in contact with the rail flank 202.

If, for example, the rail-bound drive device 100 according to the invention is moved along the direction of movement A1 along the monorail system 200, which is laid on the base without additional fixation such as for example by means of bolts, then the pressing unit 120*a*, which moves forward in the direction of movement A1, ensures by means of the loading roller 122*a*, which is pressed onto the monorail system 200 via the spring element 123*a*, and the thus resulting contact pressure that the monorail system 200 remains in its position on the base and is not displaced or even partially lifted from the base as a result of a load, for example a maintenance device, arranged on the rail-bound drive device 100. The second pressing unit 120*b* trailing in the direction of movement A1 also ensures the stability of the rail section of the monorail system 200 in the immediate vicinity of the rail-bound drive unit 100.

The pivotability of the pressing unit 120*a*, 120*b* via the swivel axes S1, S2 improves the movement of the rail-bound drive device 100 according to the invention along the monorail system 200, which usually also extends in curves.

Figure 4:
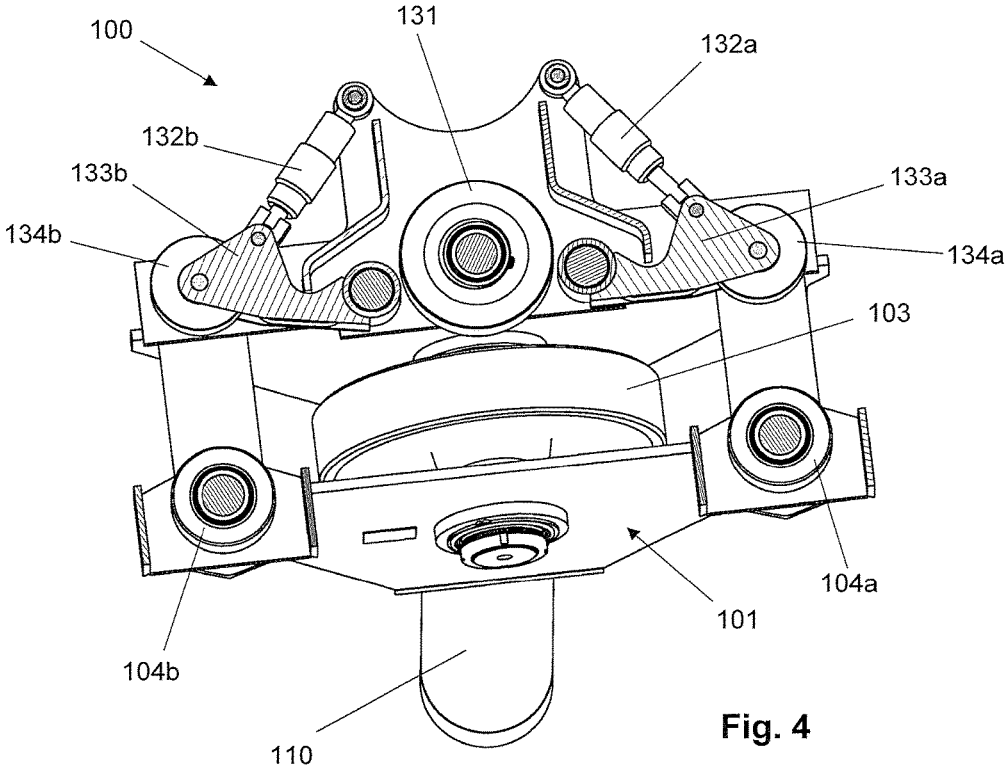
FIG. 4 shows a second embodiment of the drive unit of the drive device in a first perspective view.
Figure 5:
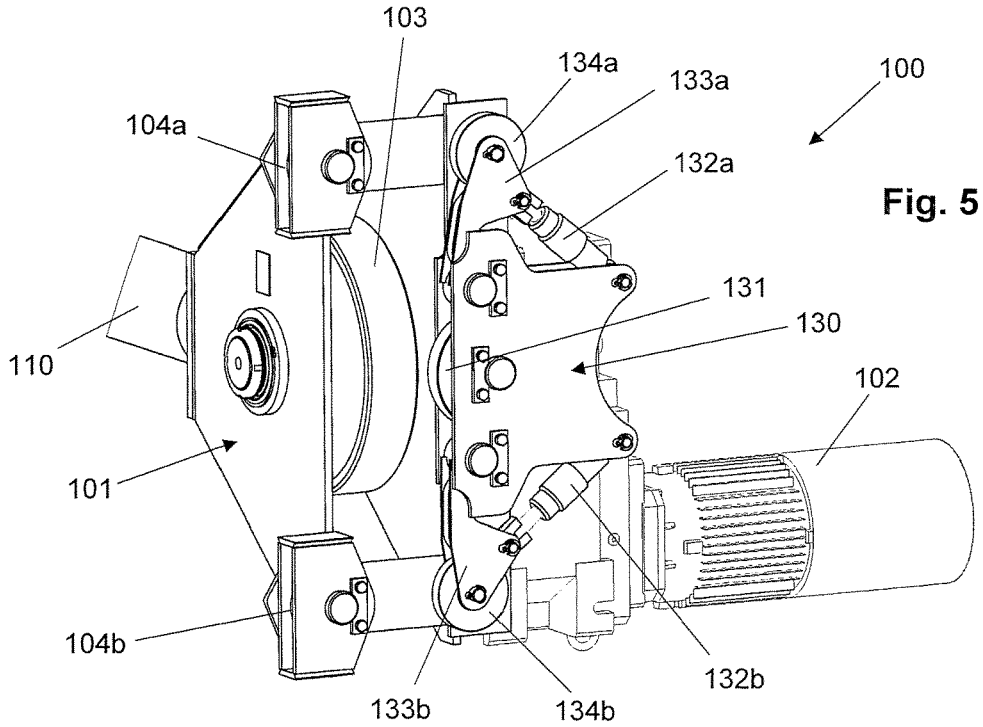
FIG. 5 shows the drive unit from FIG. 4 in a second perspective view.
Figure 6:
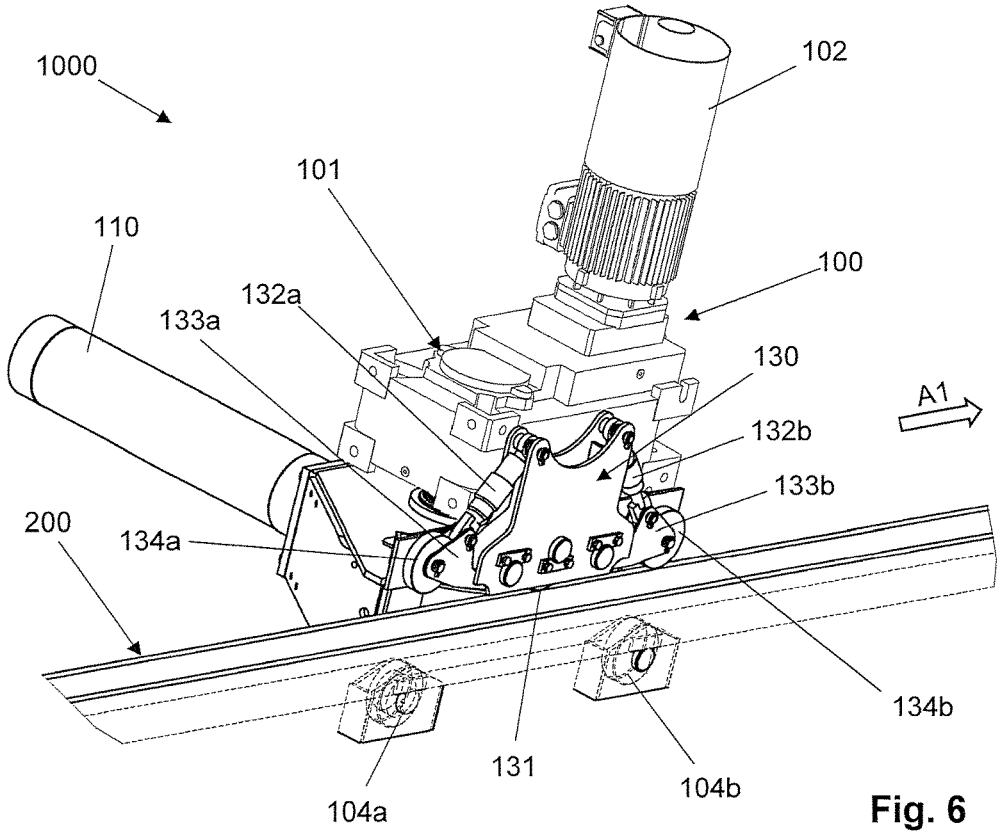
FIG. 6 shows the drive unit from FIG. 4 in a third perspective view which is arranged on a rail section of the monorail system.

Another embodiment of the drive device 100 according to the invention is shown in FIGS. 4 to 6. The drive unit 101 of the rail-bound drive device 100 according to the invention has an additional fixing device 130, which further improves the running stability of the running wheel 103 on the monorail system 200. The fixing device 130 consists of a fixing roller 131, which is arranged in a plane normal to the running roller 103, and which is also designed to be in frictional contact with the rail flank 202. Further stabilizing rollers 134*a*, 134*b* can be pressed against the rail flank 202 via one hydraulic cylinder 132*a*, 132*b* each, which is in articulated connection with an oscillating lever 133*a*, 133*b*.

The fixing roller 131 of the fixing device 130 as well as the guide rollers 104*a*, 104*b* of the drive unit 101 each lie in one plane (FIG. 4) and form a (virtual) triangle, in the center of which the running roller 103 of the drive unit 101 is arranged parallel to the base line of the triangle. The pivotable stabilizing rollers 134*a*, 134*b* of the fixing device 130 are pressed against the rail flank 202 depending on the direction of movement A1, A2 in such a way that the leading stabilizing rollers 134*a*, 134*b* are in frictional contact with the rail section of the monorail system 200 (FIG. 6).

The variant of the drive unit 101 shown in FIGS. 4 to 6 can be driven with or without additional pressing units 120*a*, 120*b*, as shown in FIGS. 1 to 3.

Figure 7:
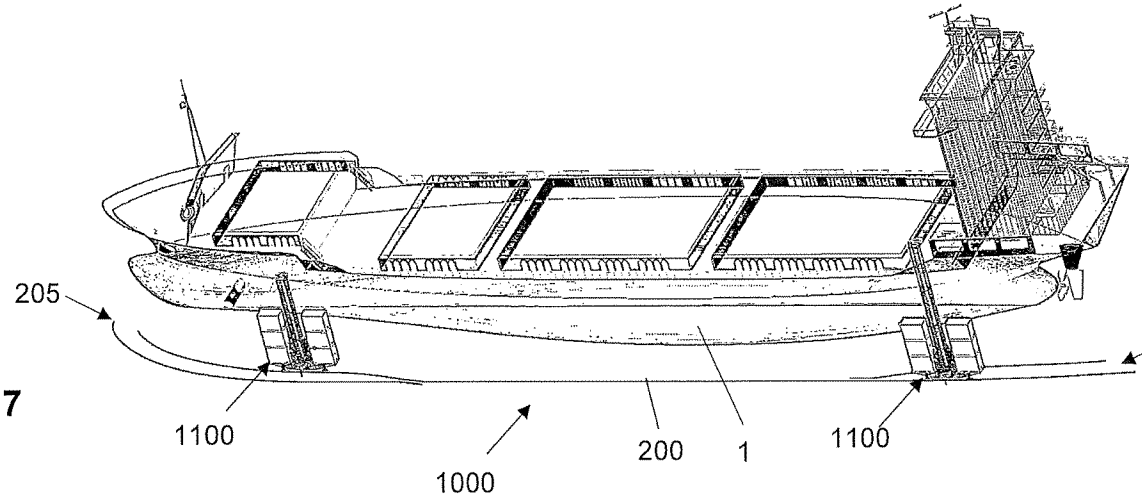
FIG. 7 shows a schematic view of the transport system according to the invention with maintenance devices.

The monorail system described in the following is also part of the transport system 1000 according to the invention, which is shown in a preferred embodiment in FIG. 7. Here the monorail system 200 is arranged along a ship hull 1 in order to be able to move maintenance devices 1100 as required along the hull 1. The maintenance devices 1100 are arranged on the drive device 100 described above. According to the invention, the monorail system 200 is simply laid on the ground without additional fixation, in this case on the ship dock.

Figure 8:
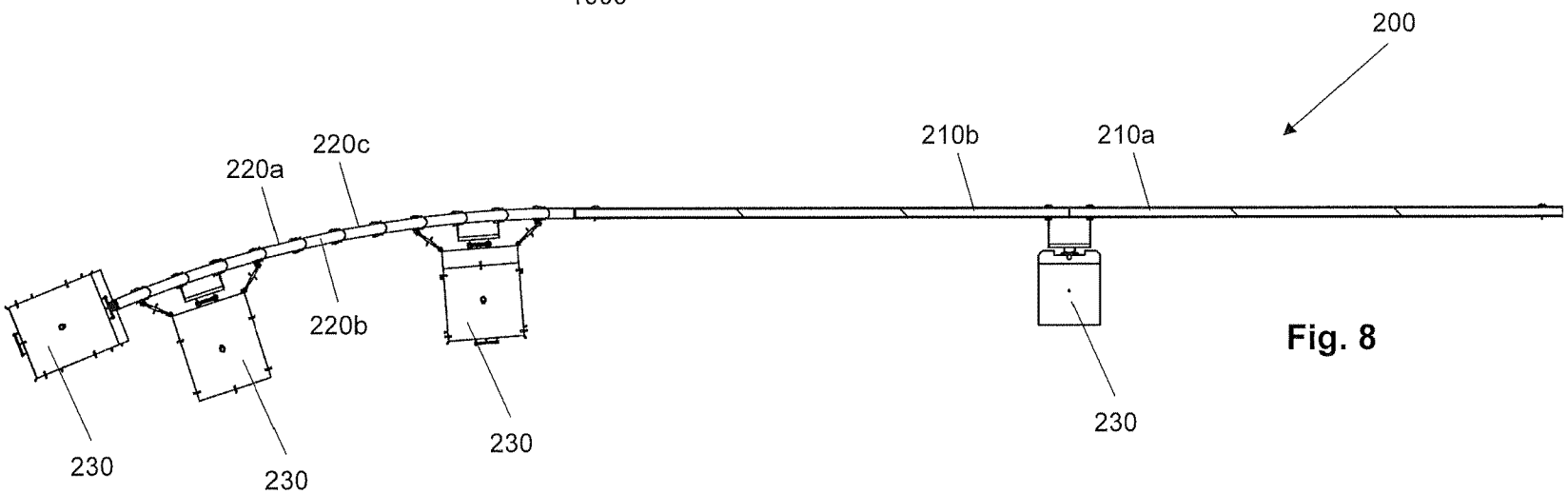
FIG. 8 shows a section of the monorail system from FIG. 1 or FIG. 7.

It can be seen from FIG. 8 that the monorail system 200 according to the invention is composed of a multitude of straight rail segments 210*a*, 210*b* as well as curved rail segments 220*a*, 220*b*, 220*c*. The monorail system 200 is held in this case in position on the base solely by frictional engagement, wherein the weight of the maintenance devices

1100, which can be moved on the monorail system 100, in particular presses said device onto the often uneven surface.

In addition, this frictional connection is supported by ballast elements 230, preferably in the form of concrete slabs, which are detachably attached to one, preferably two, adjacent rail segments 210*a*, 210*b*, 220*a*, 220*b*, 220*c*. These ballast elements 230 can also be equipped with anti-slip mats arranged on their support surface.

Figure 9:
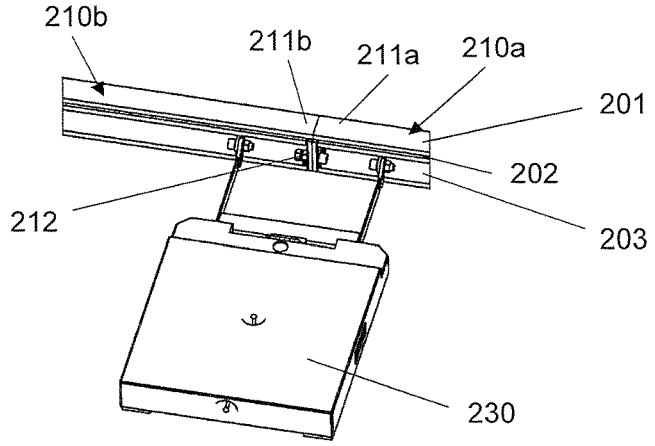
FIG. 9 shows a first detailed view of the monorail system from FIG. 8 on the straight rail segments.

Elongated rail segments 210*a*, 210*b* are provided for the laying of essentially straight sections, which are laid flush together with their straight rail segment ends 211*a*, 211*b* and screwed together by means of fixing screws 212 (FIG. 9). These elongated rail segments 210*a*, 210*b* have an essentially I-shaped cross-section with a bearing surface resting on the base, the lower flange 203, a rail surface preferably provided with a wear layer, the upper flange 201 as well as a web which is positioned normal to the lower flange 203 and the upper flange 201 and which forms the rail flank 202.

Curved rail segments 220*a*, 220*b*, 220*c* are provided according to the invention for the laying of curved sections. These curved rails segments 220*a*, 220*b*, 220*c* each have a convex rail end piece 221*a*, 221*b*, 221*c* which engages in a concave rail end piece 222*b*, 222*c* of an adjacent curve segment 220*a*, 220*b* (FIG. 10A).

Figure 10A:
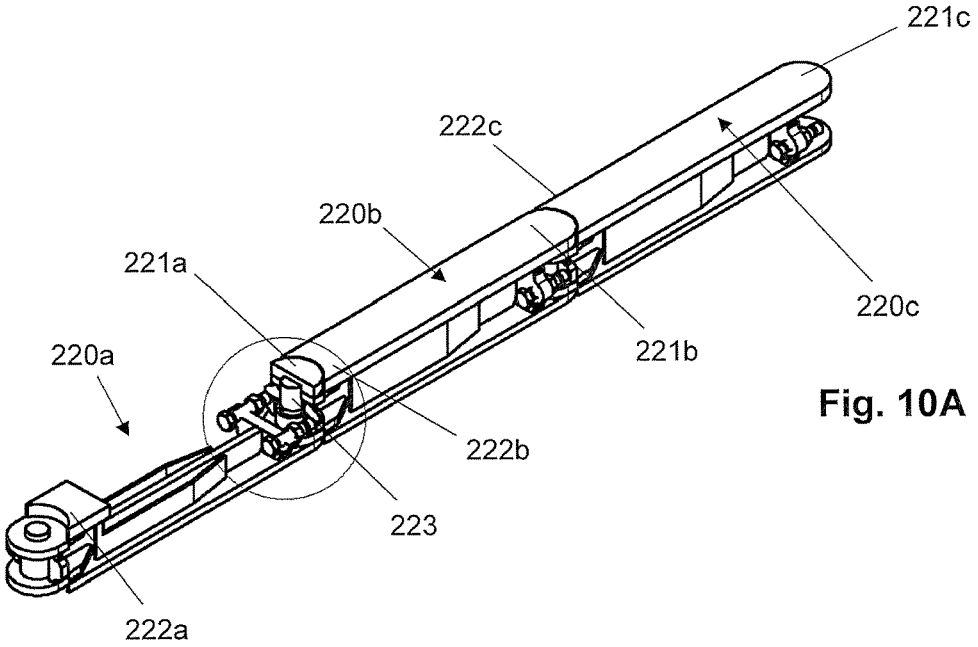
FIG. 10A shows a second detailed view of the monorail system from FIG. 8 on the curved rail segments.
Figure 10B:
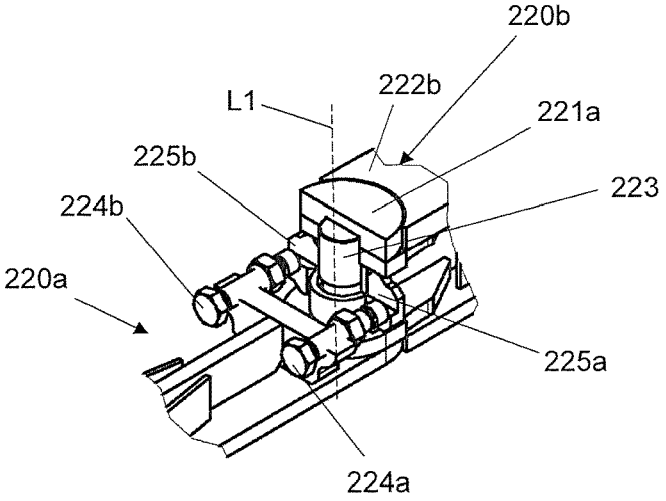
FIG. 10B shows a detailed view of the curved rail segments from FIG. 10A.

According to FIG. 10A and FIG. 10B, in which the upper flange 201 of the first curved rail segment 220*a* was only partially shown to illustrate the articulated connection between adjacent curved rail segments 220*a*, 220*b*, 220*c*, a fitting pin 223 is provided, which connects the rail end pieces 221*a*, 222*b* to each other so that they can be pivoted in relation to each other. To adjust and fix the curvature of the track section, the curved rail segments 220*a*, 220*b*, 220*c* which are connected to each other in an articulated manner are rotated relative to each other via the longitudinal axis L1 of the fitting bolt 223 and fixed in their position relative to each other by means of set screws 224*a*, 224*b*. The set screws 224*a*, 224*b* of the first curved rail segment 220*a* each interact for this purpose with a stop 225*a*, 225*b* on the adjacent second curved rail segment 220*b*.

If both set screws 224*a*, 224*b* touch the respective stop 225*a*, 225*b*, then the two adjacent curved rail segments 220*a*, 220*b* are aligned straight to each other as shown in FIG. 10B, their respective longitudinal axes lie on a common straight line. If the two adjacent curved rail segments 220*a*, 220*b* are arranged pivoted relative to each other in order to obtain a curvature of the track section of the monorail system, their respective longitudinal axes intersect at a predeterminable angle, wherein the first set screw 224*a* touches its stop 225*a*, while the second set screw 224*b* is in a position spaced from its stop 225*b*.

Figure 11A:
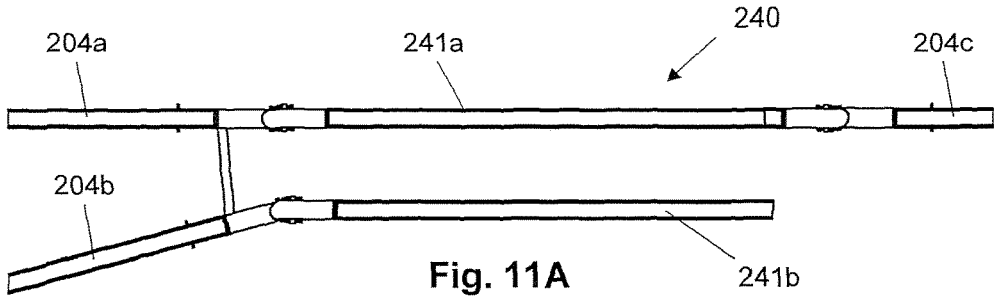
FIG. 11A shows a top view of a switch element in a first position.
Figure 11B:
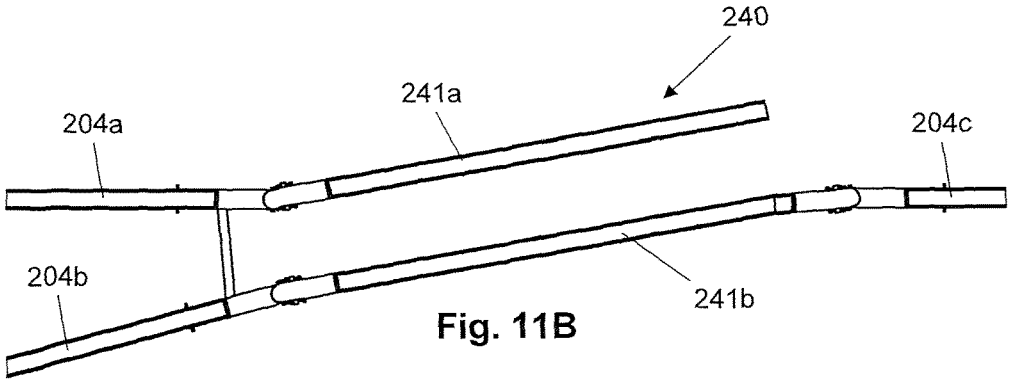
FIG. 11B shows a top view of the switch element from FIG. 11A in a second position.

Furthermore, the monorail system 200 according to the invention has switch elements 240, as shown in FIGS. 11A and 11B. The switch element 240 according to the invention has two pivoting switch tongues 241*a*, 241*b*, each of which is in articulated connection with one rail section 204*a*, 204*b*. By pivoting the two switch tongues 241*a*, 241*b* substantially parallel, either the first rail section 204*a* is connected to a third rail section 204*c* (FIG. 11A) or the second rail section 204*b* is connected to the third rail section 204*c* (FIG. 11B) and can be driven on accordingly by the maintenance device 1100 (FIG. 7).

The monorail system 200 according to the invention is usually installed outdoors, for example on ship docks, and is thus exposed to outside temperatures and at least partially to solar radiation. These often high temperatures cause a linear expansion of the monorail system 200, which may lead to bulging and/or displacement of the monorail system 200. However, this poses a significant risk to the operation of maintenance devices 1100.

Figure 12A:
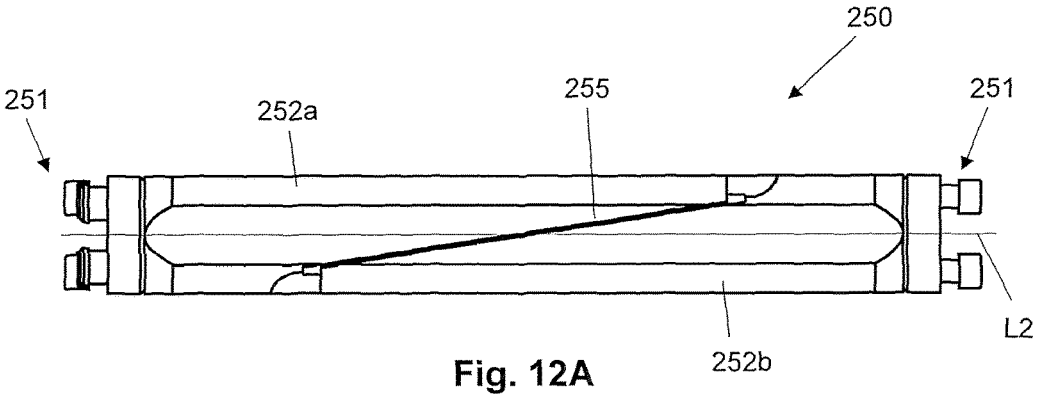
FIG. 12A shows a top view of a length compensation element.
Figure 12B:
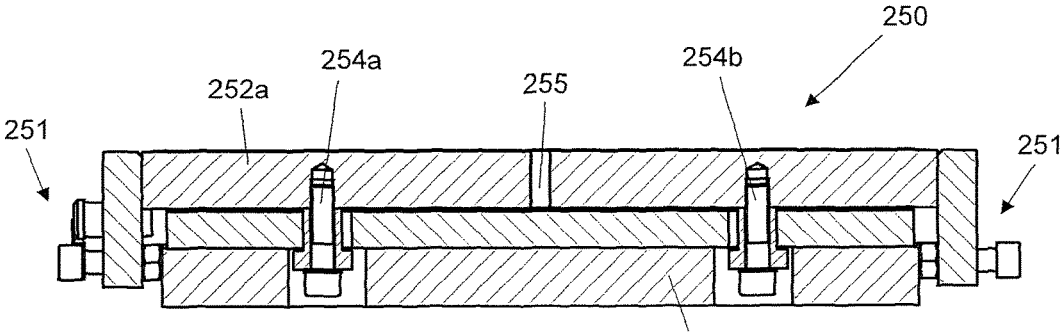
FIG. 12B shows a sectional view of the length compensation element from FIG. 12A.

Therefore, in this embodiment of the invention, additional length compensation elements 250 are provided (FIGS. 12A and 12B), which are preferably arranged at regular intervals, usually in the straight line sections, between the rail segments 210*a*, 210*b*.

The length compensation element 250 is rigidly connected to the adjacent rail segments 210*a*, 210*b* via rail connection elements 251. It consists of two tread elements 252*a*, 252*b*, which are each connected to a base element 253, which rests on the base when assembled, via a screw connection 254*a*, 254*b*. These screw connections 254*a*, 254*b* are immovably screwed to the tread elements 252*a*, 252*b*, but can be moved within the base element 253 parallel to the longitudinal axis L2 of the length compensation element 250. The two tread elements 252*a*, 252*b* are arranged at a distance from each other via a gap 255. If, for example, the longitudinal extension of the rail segments of the monorail system 200 changes due to solar radiation, the distance between the tread elements 252*a*, 252*b* also changes due to the resulting compression and the gap 255 is thus reduced. Since the change in the length extension of the rail segments due to temperature fluctuations can be significant, this embodiment of the length compensation element 250 according to the invention provides that the required gap 255 extends obliquely to the longitudinal axis L2 of the length compensation element 250 in order to ensure trouble-free movement of a running wheel 103, located on the tread elements 252*a*, 252*b*, of the previously described drive device 100 for the maintenance device 1100.

In order to lay the monorail system 100 according to the invention on a base, e.g. a ship dock, it is preferably provided that in a first step the individual rail segments 210*a*, 210*b*, 220*a*, 220*b*, 220*c* as well as, if necessary, switch elements 240 and length compensation elements 250 are connected to each other. The curved rail segments 220*a*, 220*b*, 220*c* are first joined together in a straight line and then, by adjusting the corresponding set screws 223*a*, 223*b* in the manner described above, a curved course of this section of track is obtained, for example by means of ground markings on the ground.

In a final step, ballast elements 230 may be placed at particularly vulnerable points on the rail segments 210*a*, 210*b*, 220*a*, 220*b*, 220*c* in order to improve the frictional connection of the monorail system 200 with the base in the corresponding areas. This is particularly necessary at the end sections 205 of the monorail system 200 to prevent the end sections 205 from being lifted off when the 200 monorail system is driven over by the maintenance devices 1100 which weigh tons. In fact, the fixation of the monorail system 200 on the base is practically achieved by the frictional locking achieved by the weight of the maintenance devices 1100.

An essential advantage of the monorail system 200 according to the invention lies in its frictional or non-positive positioning on the base, without the need for additional positive-locking measures such as screw or bolt connections with the base or complex preparations of the base, such as in the form of a track bed. This allows a quick assembly or disassembly of the monorail system 200 according to the invention on the spot, as well as a quick and easy relocation of the monorail system and, if necessary, adaptation of the rail course.

The invention claimed is:

1. A transport system for moving at least one automated maintenance device for large, essentially vertical surfaces, the transport system comprising:
a monorail; and
at least one drive device configured to move on the monorail along a direction of movement, the at least one drive device includes
a drive unit with
at least one running wheel, and
at least one electric drive coupled to the at least one running wheel and configured to drive the at least one running wheel, and
at least one pressing unit connected to the drive unit, wherein the at least one pressing unit includes
at least one loading roller configured to be pressed against the monorail via at least one spring element, and/or a fixing device arranged on the drive unit; and
the fixing device including a fixing roller which interacts with the monorail.

2. The transport system according to claim 1, wherein the at least one pressing unit is additionally in contact with the monorail via at least one guide roller.

3. The transport system according to claim 2, wherein the at least one pressing unit is in articulated connection with the drive unit.

4. The transport system according to claim 3, wherein the at least one pressing unit is connected to the drive unit via a swivel arm with at least one swivel axes.

5. The transport system according to claim 1, wherein the drive unit is in contact with the monorail via at least one guide roller, wherein the axis of rotation of the at least one guide roller is aligned substantially normally to the axis of rotation of the at least one running wheel of the drive unit.

6. The transport system according to claim 1, wherein the fixing device additionally includes at least one pivotable stabilizing roller which cooperates with the monorail.

7. The transport system according to claim 6, wherein the at least one pivotable stabilizing roller is pressed against the monorail via at least one hydraulic cylinder.

8. The transport system according to claim 1, wherein the drive unit has a connecting element in the form of a king pin.

9. The transport system according to claim 1, wherein the monorail includes
a plurality of rail segments, wherein the plurality of rail segments include at least two curved rail segments, wherein the first curved rail segment is a convexly constructed rail end piece and the second curved rail segment is a concavely constructed rail end piece, and the first and second curved rail segments are coupled to one another in an articulated fashion.

10. The transport system according to claim 9, wherein the at least one convexly constructed rail end piece of the first curved rail segment engages into the concavely constructed rail end piece of the adjacent second curved rail segment, and wherein a fitting bolt connects the two curved rail segments to one another, the fitting bolt configured to facilitate a pivotable relationship between the two curved rail segments.

11. The transport system according to claim 9, wherein two set screws are provided on each curved rail segment, the two set screws are configured for adjusting the curvature of a section of track which is essentially formed from curved rail segments and which cooperate with a stop arranged on the adjacent curved rail segment.

12. The transport system according to claim 9, further including additional ballast elements arranged on at least one rail segment of the monorail.

13. The transport system according to claim 9, wherein the monorail further includes at least one switch element.

14. The transport system according to claim 13, wherein the at least one switch element has two switch tongues configured to be pivoted substantially parallel to one another.

15. The transport system according to claim 9, wherein the monorail further includes at least one length compensation element.

16. The transport system according to claim 15, wherein the at least one length compensation element has two running surface elements which are separated from one another by a gap extending obliquely to the longitudinal axis of the length compensation element and which are arranged movably relative to one another on a base element.

17. A method of operating a transport system including the steps of:
providing a monorail;
providing at least one drive device to move on the monorail along a direction of movement, the at least one drive device including a drive unit with at least one running wheel and at least one electric drive coupled to the at least one running wheel and configured to drive the at least one running wheel, and at least one pressing unit connected to the drive unit, wherein the at least one pressing unit includes at least one loading roller configured to be pressed against the monorail via at least one spring element, and/or a fixing device arranged on the drive unit; and
providing the fixing device including a fixing roller which interacts with the monorail;
moving maintenance devices across the monorail via the at least one drive device; and
processing substantially vertically extending surfaces via the maintenance device.

18. The method of claim 17, further including fixing the monorail to a base by means of frictional locking.

19. A maintenance system comprising:
at least one maintenance device; and
a transport system including
a monorail, and
at least one drive device configured to move on the monorail along a direction of movement, the at least one drive device including
a drive unit with at least one running wheel,
at least one electric drive coupled to the at least one running wheel, the at least one electric drive configured to drive the at least one running wheel, and
at least one pressing unit connected to the drive unit, wherein the at least one pressing unit includes at least one loading roller configured to be pressed against the monorail via at least one spring element, and/or a fixing device arranged on the drive unit; and
the fixing device including a fixing roller which interacts with the monorail; and
wherein the at least one maintenance device is arranged on the at least one drive device of the transport system and is configured to be moved automatically on the monorail.

* * * * *